US006146230A

United States Patent [19]

Kim et al.

[11] Patent Number: 6,146,230

[45] Date of Patent: Nov. 14, 2000

[54] COMPOSITION FOR ELECTRON EMITTER OF FIELD EMISSION DISPLAY AND METHOD FOR PRODUCING ELECTRON EMITTER USING THE SAME

[75] Inventors: Chang-Wook Kim; Kwi-Seok Choi, both of Seongnam; Sang-Jin Lee, Suwon; Jae-Myung Kim, Suwon; Joong-Woo Nam, Suwon, all of Rep. of Korea

[73] Assignee: Samsung Display Devices Co., Ltd., Suwon-si, Rep. of Korea

[21] Appl. No.: 09/405,613

[22] Filed: Sep. 24, 1999

[30] Foreign Application Priority Data

| | | | |
|---|---|---|---|
| Sep. 24, 1998 | [KR] | Rep. of Korea | 98-39660 |
| Sep. 24, 1998 | [KR] | Rep. of Korea | 98-39661 |
| Mar. 30, 1999 | [KR] | Rep. of Korea | 99-11045 |

[51] Int. Cl.[7] ..... H01J 9/02

[52] U.S. Cl. ..... 445/51; 252/500; 252/502; 445/58

[58] Field of Search ..... 252/502, 518, 252/500; 445/58, 50, 51

[56] References Cited

U.S. PATENT DOCUMENTS 5,947,783 9/1999 Bojkov et al. ..... 445/58

*Primary Examiner*—Kenneth J. Ramsey
*Attorney, Agent, or Firm*—Christie, Parker & Hale, LLP

[57] ABSTRACT

An electron emitter composition comprising electron emitting materials, dispersion agent, binder, and pure water is provided.

An electron emitter of an FED is produced by the steps of forming a photoresist layer by coating and drying a photoresist composition on an electrode formed on a back plate (cathode plate); exposing and developing the photoresist layer into a predetermined pattern using a mask; forming an electron emitting layer by coating and drying an electron emitter composition consisting of electron emitting materials, a binder, a dispersion agent, and pure water on the developed photoresist layer; exposing the photoresist layer by etching the electron emitting layer; and washing and drying it after stripping the exposed photoresist layer.

18 Claims, 1 Drawing Sheet

COMPOSITION FOR ELECTRON EMITTER OF FIELD EMISSION DISPLAY AND METHOD FOR PRODUCING ELECTRON EMITTER USING THE SAME

CROSS REFERENCE TO RELATED APPLICATION

This application is based on applications Nos. 98-39660, 98-39681, and 99-11045 filed in the Korean Industrial Property Office on Sep. 24, 1998, Sep. 24, 1998, and Mar. 30, 1999, respectively, the content of which are incorporated herein by reference.

BACKGROUND OF THE INVENTION (a) Field of the Invention

The present invention relates to a composition for an electron emitter of a Field Emission Display (hereinafter referred to as an FED) and a method for producing the electron emitter of an FED using the composition. The present invention relates more particularly to a composition for an electron emitter for forming a flat type electron emitter and a method for producing a flat type electron emitter used as a cathode in an FED.

(b) Description of the Related Art

A Field Emission Display (FED) is a type of Flat Panel Display (FPD) on which research and development is actively being pursued because it has lighter weight and less volume than conventional cathode-ray tubes (CRT). Furthermore, a Field Emission Display is advantageous because it consumes less power and is therefore appropriate for a large scale display.

As shown in FIG. 1, an FED (100) includes a front plate (20), a back plate (30), and side walls (40) and spacers (50) for enclosing and supporting the front plate (20) and back plate (30), inside of which is maintained in a vacuum condition of about $1\times10^{-7}$ torr. The front plate (20) is generally called an anode plate. On the inside wall of the front plate (20) are formed stripe type Indium Tin Oxide (ITO) electrodes (60) that apply the required pulse voltages to each pixel. A phosphor pattern (62) is formed on the Indium Tin Oxide (ITO) electrodes (60) to display images. The back plate (30), is generally called a cathode plate. On the inside wall of the back plate Ag or ITO electrodes (70) are formed perpendicular to the ITO electrodes (60) on the front plate (20), and electron emitters (72) are coated on the electrodes (70). In this FED (100) when image signals are applied by a driver circuit (not shown) to the ITO electrodes (60) and (70), a strong electric field is formed between both electrodes. The electron emitters (72) are excited by the strong electric field, resulting in electron emission (not shown). The emitted electrons penetrate the space maintained in a vacuum condition and excite the phosphor pattern (62) to emit visible rays.

In order to fabricate this FED (100), stripe type ITO electrodes (60) are first formed by sputtering ITO on the front plate (20) and etching the sputtered ITO. Then pastes for forming the side walls (40) and the spacers (50) are printed at appropriate parallel distances and heat treated. A phosphor pattern is formed on the ITO electrodes (60) by a printing or spin coating method, and then sealing frit is coated on the edge of the front plate (20). Next, a stripe type ITO or Ag electrode (70) pattern is coated on the back plate (30) by a sputtering or screen printing method. Then pastes for forming side walls (40) and the spacers (50) are printed at appropriate parallel distances and heat treated. The electron emitter (72) pattern is formed by coating a composition of electron emitter on the electrodes (70), and then sealing frit is coated on the edge of the back plate (30). The FED (100) is fabricated by assembling the front plate (20) and the back plate (30) in parallel and heating them under an appropriate pressure to form a seal. Then the sealed FED (100) is evacuated to form a vacuum. For electron emitters (72), cone type emitters made by molybdenum deposition or by silicon sharpening, or flat type emitters using diamond or diamond like carbon (DLC), etc. are generally used.

Cone type emitters containing molybdenum (i.e., spindt type emitters) or cone type emitters containing silicon require a high vacuum environment of about $10^{-8}$ torr in the panel to minimize emitter tip damage due to remaining gas or ion impact. When this environment is not maintained, the emitter tip is likely to be damaged. Furthermore, the cone type emitters cost much more due to thin coating processes including: sputtering, exposing, etching, etc., and it is difficult to form uniform cone type emitters on a large scale substrate plate.

To fabricate the flat type emitters containing diamond or diamond like carbon, chemical vapor deposition, plasma enhanced chemical vapor deposition, laser ablation deposition, etc. are used. However, it is difficult to fabricate a large scale emitter and to provide a uniform emitter surface using these methods. Furthermore, it is economically disadvantageous due to complicated processing conditions, the high cost of necessary facilities, etc.

SUMMARY OF THE INVENTION

It is an object of the present invention to provide a composition for an electron emitter and a method for producing the electron emitter of an FED using the composition in which the fabrication process is simple and large scale panel fabrication is easy. It is another object of the present invention to provide an electron emitter composition and a method for producing the electron emitter which is capable of forming a highly precise and large scale electron emitter pattern by a simple and convenient coating process.

In order to achieve the above objects of the present invention, the present invention provides a composition for an electron emitter of an FED comprising electron emitting materials, a dispersion agent including polyoxyethylene nonyl phenyl ether derivative or polyvinylpyrrolidone, a binder including silane based compounds or colloidal silicas, and pure water.

Furthermore, the present invention provides a method for producing an electron emitter of an FED comprising the steps of forming a photoresist layer by coating and drying a photoresist composition on an electrode formed on a cathode plate, exposing and developing the photoresist layer into a predetermined pattern using a mask, forming an electron emitting layer by coating and drying an electron emitter composition comprising electron emitting materials, binder, dispersion agent, and pure water on the photoresist layer pattern, exposing the photoresist layer by etching the electron emitting layer, and washing and drying the electron emitting layer after stripping the exposed photoresist layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawing, wherein.

DETAILED DESCRIPTION OF THE PREFERRED EMBODIMENTS

Figure 1:
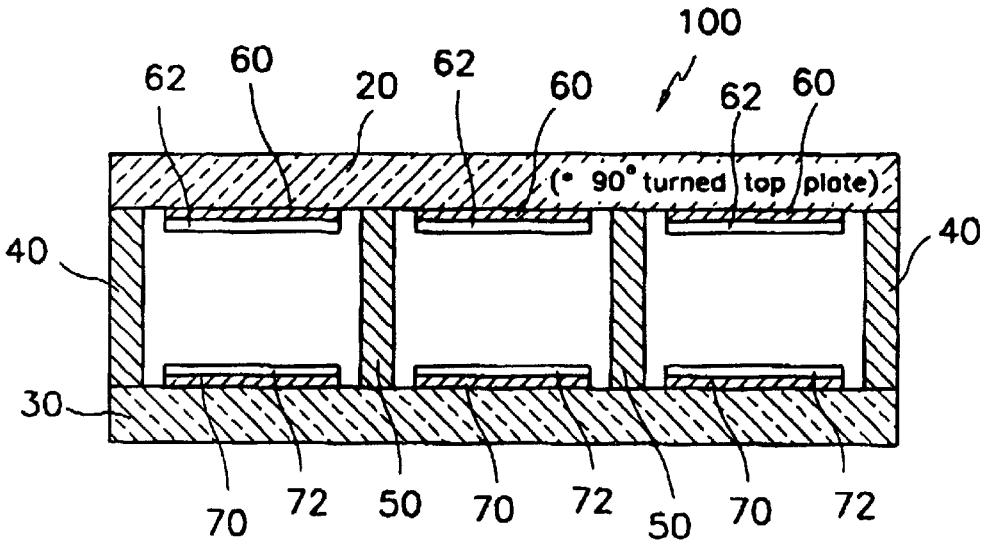
FIG. 1 is a side cross sectional view showing an FED having an electron emitter which is fabricated with a composition according to an embodiment of the present invention.

In the following detailed description, only the preferred embodiment of the invention has been shown and described, simply by way of illustration of the best mode contemplated by the inventors of carrying out the invention. As will be realized, the invention is capable of modification in various obvious respects, all without departing from the invention. Accordingly, the drawing and description are to be regarded as illustrative in nature, and not restrictive.

An electron emitter composition according to an embodiment of the present invention comprises one or more electron emitting materials selected from the group consisting of carbon materials such as graphite powder, diamond-like-carbon (DLC), carbon nanotube in which graphite sheet is rolled up circularly, carbon fiber powder, boron nitride (BN) powder having an energy band gap of 2.7 to 4.5 electron volts (eV), and aluminum nitride (AlN) powder. Similar to the diamond-like-carbon, the boron nitride and aluminum nitride emit electrons due to their negative electron affinity (NEA) effect. The composition also comprises binder, dispersion agent, and pure water.

The graphite powder has particle diameters preferably from 0.5 to 3 $\mu$m, and more preferably from 0.5 to 1 $\mu$m. Graphite particles having diameters of less than 0.5 $\mu$m are not commercially practical. If the particle diameters exceed 3 $\mu$m, non-uniform electron emission occurs due to the rough surface of the emitter.

The amount of the electron emitting material is preferably 1 to 50 weight %, more preferably 5 to 30 weight %, and most preferably 10 to 20 weight % of the total composition. When the amount of electron emitting material is below 1 weight %, electrons are rarely emitted from the material, and when the amount of the electron emitting material exceeds 50 weight %, manufacturing becomes difficult due to a high viscosity of the electron emitter composition.

The dispersion agent is preferably polyoxyethylene nonyl phenyl ether derivative, polyvinylpyrrolidone, etc. The binder is preferably silane based compounds, colloidal silicas, etc.

The above polyoxyethylene nonyl phenyl ether derivative or polyvinylpyrrolidone is used to disperse electron emitting materials in the electron emitter composition. The preferable amount of this dispersion agent is from 0.01 to 20 weight %, more preferably 0.5 to 5 weight %, and most preferably 1 to 3 weight % of the total composition. When the amount of dispersion agent is below 0.01 weight %, electron emitting materials in the composition are not dispersed uniformly, and when the amount of dispersion agent exceeds 20 weight %, electron emission from the electron emitting materials is likely to be reduced.

According to an embodiment of the present invention, silane based compounds or colloidal silica is used to bind the composition on a cathode electrode which is made of Ag, ITO, etc. The preferable amount of this binder is from 0.01 to 50 weight %, more preferably 1 to 20 weight %, and most preferably 1 to 5 weight % of the total composition. When the amount of binder is below 0.01 weight %, the electron emitter is easily detached from the cathode electrode, and when the amount of binder exceeds 50 weight % the electron emission from electron emitting materials is likely to be obstructed by the binder.

The remainder of the composition is a dispersion medium. A composition according to an embodiment of the present invention uses water, preferably pure water, as the dispersion medium.

After mixing the electron emitting materials, dispersion agent, and pure water, the mixture is stirred while ball milling, for example, with zirconium balls, for about 48 hours. Then the binder is added, and the resultant material is stirred with a magnetic bar for about 6 hours in order to produce the electron emitter composition according to the present invention.

Subsequently, a flat type electron emitter (72) is fabricated on a back plate (30) (cathode plate) using the prepared electron emitter composition as shown in FIG. 1. In detail, a photoresist is first coated on the back plate (30) (cathode plate), and a photoresist pattern is formed by exposing the photoresist to light and then developing the photoresist.

Then, an electron emitting layer is formed by coating the electron emitter composition comprising the electron emitting materials, the binder, the dispersion agent, and the pure water on the photoresist pattern, and then drying the composition. The electron emitting layer is etched to expose the photoresist layer. After stripping the exposed photoresist layer, the electron emitting layer is washed and dried.

Generally, it is known that a carbon layer for the toner of a copy machine or black matrix of a Cathode Ray Tube (CRT) is formed by a slurry which is prepared by dispersing carbon black into a liquid phase oil solvent. However, when the electron emitter of an FED is fabricated using these materials, electron emission effects drop or electrons are not emitted at all. This is because these carbon emitter compositions contain various organic materials and binder. Therefore, to prepare the electron emitter composition for the FED it is important to use a minimum quantity of reagent and to mix them in a proper ratio, and the bonding strength of the prepared electron emitter composition to the substrate plate should be excellent. Additionally, the electron emitter composition to be used in a fabrication of an FED should not contain electron emission obstructing materials.

In order to fabricate the FED, after an ITO is sputtered on a glass substrate plate (front plate) and etched to form stripe type anode electrodes, phosphor patterns are formed on the etched anode electrode by a printing method, and then the anode plate is heat treated. Subsequently, pastes for forming spacers and side walls are printed parallel between the phosphor patterns, and then heat treated to form the anode substrate plate.

Stripe type cathode electrodes are formed by sputtering or screening printing ITO or Ag on the other glass substrate plate (back plate). Subsequently, pastes for spacers and side walls are printed parallel between the cathode electrodes, and heat treated to form the cathode substrate plate.

In order to form the flat type electron emitters (72) (which act as a cathode) using the above prepared electron emitter composition by a photolithography method, a photoresist layer is first formed by coating a photoresist composition on the back plate on which the electrodes are formed, and then rotated using a spin coater. The photoresist layer is then dried in a drying oven. Next, after a mask is put on the photoresist layer formed on the substrate plate, the photoresist layer is exposed to light using an I-line mercury lamp, and developed by removing non-light exposed photoresist parts using a low pressure development nozzle. The substrate plate is spun to remove moisture and then dried in an oven. Next, the electron emitter composition is coated and rotated on the above developed photoresist layer by using a spin coater to form an electron emitting layer. The electron emitter composition comprises electron emitting materials, a dispersion agent of polyoxyethylene nonyl phenyl ether derivative or polyvinylpyrrolidone, a binder of silane based compounds or colloidal silica, and pure water. The substrate plate with the formed electron emitting layer is dried in a drying oven. This layer is then etched with a dilute sulfuric acid solution, and its patterning is made by stripping the remaining photoresist. It is then washed and dried in an oven to complete the back plate. The above photolithography process is not restricted to the above conditions, and can be applied with various modifications according to the convenience of the manufacturer.

Seal frit is coated on the edges of the fabricated anode substrate plate and cathode substrate plate. They are aligned so that the anode electrodes and the cathode electrodes are perpendicular to each other, and sealed by heat treating with a proper pressure. Subsequently, the assembly is evacuated to form a vacuum so as to complete the production of an FED (100).

In this FED (100), electrons are emitted from the electron emitters (72) because of the strong electric field formed between the ITO electrodes (60) (anode electrode) formed on the front plate (20) and the ITO electrodes (70) (cathode electrode) formed on the back plate (30). These electrons strike the phosphor pattern (62) formed on the anode electrode (60) to emit visible rays.

The below preferred examples are provided to help in the understanding of the present invention. However, the present invention is not limited to the following examples.

EXAMPLE 1

After mixing 5 g of graphite having particle diameters of about 0.7 μm (manufactured by Dong-won Ceramic Corporation of Korea), and 0.2 g of polyoxyethylene nonyl phenyl ether derivative (NP1018 manufactured by Dong-nam Synthesis Corporation of Korea) with 30 g of pure water, the mixture was stirred by ball milling with zirconium balls for 48 hours. An electron emitter composition was prepared by adding 0.5 g of silane (KBM603 manufactured by Shin-etsu Corporation of Japan) to this mixture and stirring it with a magnetic bar for 6 hours.

At the same time, a cathode substrate plate was prepared in which line type cathode electrodes were formed by screen printing ITO on a glass substrate plate, and line type spacers were formed between the cathode electrodes by a screen printing method. After forming a photoresist layer by coating and rotating a photoresist composition on the cathode substrate plate with a spin coater, the photoresist layer was dried. The photoresist composition employed was a conventional negative type photoresist composition that comprised polyvinylpyrrolidone polymer, 4,4'-diazostilbene-2,2'-sodiumdisulfonate as a photosensitive agent, polyoxyethylene octylphenolether as a surfactant, and N-(β-aminoethyl)-γ-aminopropyltrimethoxysilane as a silane coupling agent. Next, after a mask was put on the substrate plate, the photoresist layer was exposed to light from an I-line mercury lamp, and was developed by removing the non-light exposed parts with a low pressure development nozzle. After removing moisture by rotating the substrate plate with a spin coater and drying it in an oven, an electron emitting layer was formed by coating and rotating the electron emitter composition using a spin coater. The substrate plate with the electron emitting layer was then put into a drying oven and dried. After this, the electron emitting layer was etched with dilute sulfuric acid, and patterning was accomplished by stripping the remained photoresist layer using a high pressure nozzle. The back plate of an FED was completed by washing and drying it in an oven.

EXAMPLE 2

After mixing 5 g of graphite having particle diameters of about 0.7 μm (manufactured by Dong-won Ceramic Corporation of Korea), and 1 g of polyvinylpyrrolidone (PVP manufactured by BASF Corporation of U.S.A.) with 20 g of pure water, the mixture was stirred by ball milling with zirconium balls for 48 hours. An electron emitter composition was prepared by adding 2 g of colloidal silica (ST-30 manufactured by Il-san Chemical Corporation of Korea) to this mixture and stirring it with a magnetic bar for 6 hours.

At the same time, a cathode substrate plate was prepared in which line type cathode electrodes were formed by screen printing ITO on a glass substrate plate, and the line type spacers were formed between the cathode electrodes by a screen printing method. After forming a photoresist layer by coating and rotating a photoresist composition on the cathode substrate plate with a spin coater, the photoresist layer was dried. The photoresist composition employed was as a conventional negative type photoresist composition comprising polymer of polyvinylpyrrolidone, 4,4'-diazostyrene-2,2'-sodiumdisulfonate as a photosensitive agent, polyoxyethylene octylphenolether as a surfactant, and N-(β-aminoethyl)-γ-aminopropyltrimethoxysilane as a silane coupling agent. Next, after a mask was put on the substrate plate, the photoresist layer was exposed to light from an I-line mercury lamp, and was developed by removing the non-light exposed parts with a low pressure development nozzle. After removing moisture by rotating the substrate plate with a spin coater and drying it in an oven, an electron emitting layer was formed by coating and rotating the above electron emitter composition using a spin coater. The substrate plate with the electron emitting layer was dried in a drying oven. After this, the electron emitting layer was etched with dilute sulfuric acid, and patterning was accomplished by stripping the remained photoresist layer using a high pressure nozzle. The back plate of an FED was completed by washing and drying it in an oven.

As described above, when an emitter of an FED is fabricated using the electron emitter composition, the advantages are first, electrons are uniformly emitted from the electron emitter, and second, the emitter is accurately patterned such that it can be applied to large sized industrial monitor fabrication. There is also an advantage in that an electron emitter composition can be applied to the manufacturing of a large sized FED as well as other large sized Flat Display Panels (FDP) such as flat CRT's, etc.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A composition for an electron emitter of a Field Emission Display comprising:

electron emitting material;

a dispersion agent including polyoxyethylene nonyl phenyl ether derivative or polyvinylpyrrolidone;

a binder including silane based compounds or colloidal silicas; and water.

2. A composition in accordance with claim 1, wherein the electron emitting material comprises at least one compound selected from the group consisting of graphite powder, diamond-like-carbon (DLC), carbon nanotube, carbon fiber powder, boron nitride powder and aluminum nitride powder.

3. A composition in accordance with claim 2, wherein the graphite powder comprises particle diameters from 0.5 to 3 μm.

4. A composition in accordance with claim 1, wherein an amount of the electron emitting material is from 10 to 20 weight %, an amount of the dispersion agent is from 1 to 3 weight %, an amount of the binder is from 1 to 5 weight %, and an amount of the water is from 70 to 88 weight % of the composition.

5. A method for producing an electron emitter of a Field Emission Display comprising:

forming a photoresist layer by coating and drying a photoresist composition on an electrode formed on a cathode plate;

exposing and developing the photoresist layer into a predetermined pattern using a mask;

forming an electron emitting layer by coating and drying an electron emitter composition comprising an electron emitting material, a binder, a dispersion agent, and water on the photoresist pattern;

exposing the photoresist layer by etching the electron emitting layer; and washing and drying the electron emitting layer after striping the exposed photoresist layer.

6. A composition in accordance with claim 1, wherein an amount of the electron emitting material is from 1 to 50 weight %.

7. A composition in accordance with claim 1, wherein an amount of electron emitting material is from 5 to 30 weight %.

8. A composition in accordance with claim 1, wherein an amount of electron emitting material is from 10 to 20 weight %.

9. A composition in accordance with claim 1, wherein an amount of the dispersion agent is from 0.01 to 20 weight %.

10. A composition in accordance with claim 1, wherein an amount of the dispersion agent is from 0.5 to 5 weight %.

11. A composition in accordance with claim 1, wherein an amount of the dispersion agent is from 1 to 3 weight %.

12. A composition in accordance with claim 1, wherein an amount of the binder is from 0.01 to 50 weight %.

13. A composition in accordance with claim 1, wherein an amount of the binder is from 1 to 20 weight %.

14. A composition in accordance with claim 1, wherein an amount of the binder is from 1 to 5 weight %.

15. A composition in accordance with claim 1, wherein and an amount of the water is from 70 to 88 weight % in the composition.

16. A method for producing an electron emitter of a Field Emission Display according to claim 5, wherein the photoresist layer is exposed to light using an I-line mercury lamp.

17. A method for producing an electron emitter of a Field Emission Display according to claim 5, wherein the photoresist layer is developed by removing non-light exposed photoresist parts using a low pressure development nozzzle.

18. A method for producing an electron emitter of a Field Emission Display according to claim 5, wherein the electron emitting composition is coated onto the photoresist layer using a spin coater.

* * * * *